US006453285B1

(12) United States Patent
Anderson et al.

(10) Patent No.: US 6,453,285 B1
(45) Date of Patent: Sep. 17, 2002

(54) SPEECH ACTIVITY DETECTOR FOR USE IN NOISE REDUCTION SYSTEM, AND METHODS THEREFOR

(75) Inventors: David V. Anderson, Alpharetta; Stephen McGrath, Atlanta; Kwan Truong, Lilburn, all of GA (US)

(73) Assignee: Polycom, Inc., Milpitas, CA (US)

( * ) Notice: Subject to any disclaimer, the term of this patent is extended or adjusted under 35 U.S.C. 154(b) by 0 days.

(21) Appl. No.: 09/371,748

(22) Filed: Aug. 10, 1999

Related U.S. Application Data

(60) Provisional application No. 60/097,402, filed on Aug. 21, 1998.

(51) Int. Cl.[7] ..... G10L 11/02; G10L 21/02

(52) U.S. Cl. ..... 704/210; 704/226; 381/94.3

(58) Field of Search ..... 704/208, 210, 704/215, 226, 227, 228, 233, 206; 381/94.2, 94.3, 94.7

(56) References Cited

U.S. PATENT DOCUMENTS

| | | | | |
|---|---|---|---|---|
| 3,803,357 A | | 4/1974 | Sacks | |
| 4,357,491 A | | 11/1982 | Daaboul et al. | |
| 4,630,304 A | | 12/1986 | Borth et al. | |
| 4,672,669 A | | 6/1987 | DesBlache et al. | |
| 4,811,404 A | | 3/1989 | Vilmur et al. | |
| 5,012,519 A | | 4/1991 | Adlersberg et al. | |
| 5,276,765 A | * | 1/1994 | Freeman et al. | 704/233 |
| 5,459,814 A | | 10/1995 | Gupta et al. | |
| 5,577,161 A | | 11/1996 | Ferrigno | |
| 5,579,435 A | * | 11/1996 | Jansson | 381/56 |
| 5,617,508 A | * | 4/1997 | Reaves | 704/226 |
| 5,668,927 A | | 9/1997 | Chan et al. | |
| 5,768,473 A | | 6/1998 | Eatwell et al. | |
| 5,774,847 A | * | 6/1998 | Chu et al. | 704/237 |
| 5,819,217 A | * | 10/1998 | Raman | 704/233 |
| 5,825,754 A | | 10/1998 | Williams | |
| 5,907,624 A | | 5/1999 | Takada | |

(List continued on next page.)

OTHER PUBLICATIONS

Article "Robust Noise Detection for Speech Detection and Enhancement" by Garner et al., published in *Electronics Letters* Feb. 13, 1997, vol. 33, No. 4, pp. 270–271.

Article "Speech Enhancement Based on Audible Noise Suppression" by Tsoukalas et al., published in *IEEE Transactions on Speech and Audio Processing*, Nov., 1997, vol. 5, No. 6, pp. 497–514.

(List continued on next page.)

*Primary Examiner*—Marsha D. Banks-Harold
*Assistant Examiner*—Martin Lerner
(74) *Attorney, Agent, or Firm*—Carr & Ferrell LLP

(57) ABSTRACT

A system and method for removing noise from a signal containing speech (or a related, information carrying signal) and noise. A speech or voice activity detector (VAD) is provided for detecting whether speech signals are present in individual time frames of an input signal. The VAD comprises a speech detector that receives as input the input signal and examines the input signal in order to generate a plurality of statistics that represent characteristics indicative of the presence or absence of speech in a time frame of the input signal, and generates an output based on the plurality of statistics representing a likelihood of speech presence in a current time frame; and a state machine coupled to the speech detector and having a plurality of states. The state machine receives as input the output of the speech detector and transitions between the plurality of states based on a state at a previous time frame and the output of the speech detector for the current time frame. The state machine generates as output a speech activity status signal based on the state of the state machine, which provides a measure of the likelihood of speech being present during the current time frame. The VAD may be used in a noise reduction system.

19 Claims, 5 Drawing Sheets

U.S. PATENT DOCUMENTS

| | | | | | |
|---|---|---|---|---|---|
| 5,943,429 | A | * | 8/1999 | Handel | 704/226 |
| 6,044,341 | A | | 3/2000 | Takahashi | |
| 6,088,668 | A | | 7/2000 | Zack | |
| 6,108,610 | A | | 8/2000 | Winn | |
| 6,122,610 | A | * | 9/2000 | Isabelle | 704/226 |
| 6,144,937 | A | | 11/2000 | Ali | |
| 6,154,721 | A | * | 11/2000 | Sonnic | 704/233 |
| 6,160,886 | A | * | 12/2000 | Romesburg et al. | 379/410 |
| 6,275,798 | B1 | * | 8/2001 | Johansson et al. | 704/225 |
| 6,324,502 | B1 | * | 11/2001 | Handel et al. | 704/226 |
| 6,366,880 | B1 | * | 4/2002 | Ashley | 379/392.01 |
| 6,377,918 | B1 | * | 4/2002 | Series | 704/226 |

OTHER PUBLICATIONS

Article "Speech Enhancement Using a Minimum Mean–Square Error Short–Time Spectral Amplitude Estimator" by Ephraim et al., published in *IEEE Transactions on Acoustics, Speech, and Signal Processing*, Dec., 1984, vol. ASSP–32, No. 6, pp. 1109–1121.

Article "Elimination of the Musical Noise Phenomenon with the Ephraim and Malah Noise Suppressor" by Olivier Cappe, published in *IEEE Transactions on Speech and Audio Processing*, Apr., 1994, vol. 2, No. 2, pp. 345–349.

Article "New Methods for Adaptive Noise Suppression" by Arslan et al., published in *IEEE*, 1995, pp. 812–815.

Article "Suppression of Acoustic Noise in Speech Using Spectral Subtraction" by Steven F. Boll, published *IEEE Transactions on Acoustics, Speech, and Signal Processing*, Apr., 1979, vol. ASSP–27, No. 2, pp. 113–120.

Article "ITU–T Recommendation G.729 Annex B: A Silence Compression Scheme for Use with G.729 Optimized for V.70 Digital Simultaneous Voice and Data Applications" by Benyassine et al., published *IEEE Communications Magazine*, Sep., 1997, pp. 64–73.

Article "Speech Enhancement Based on Masking Properties of the Auditory System" by Nathalie Virag, published *IEEE*, 1995, pp. 796–799.

* cited by examiner

SPEECH ACTIVITY DETECTOR FOR USE IN NOISE REDUCTION SYSTEM, AND METHODS THEREFOR

This application claims priority to U.S. Provisional Application No. 60/097,402 filed Aug. 21, 1998, entitled "Versatile Audio Signal Noise Reduction Circuit and Method".

BACKGROUND OF THE INVENTION

This invention relates to a system and method for detecting speech in a signal containing both speech and noise and for removing noise from the signal.

In communication systems it is often desirable to reduce the amount of background noise in a speech signal. For example, one situation that may require background noise removal is a telephone signal from a mobile telephone. Background noise reduction makes the voice signal more pleasant for a listener and improves the outcome of coding or compressing the speech.

Various methods for reducing noise have been invented but the most effective methods are those which operate on the signal spectrum. Early attempts to reduce background noise included applying automatic gain to signal subbands such as disclosed by U.S. Pat. No. 3,803,357 to Sacks. This patent presented an efficient way of reducing stationary background noise in a signal via spectral subtraction. See also, "Suppression of Acoustic Noise in Speech Using Spectral Subtraction," *IEEE Transactions On Acoustics, Speech and Signal Processing*, pp. 1391–1394, 1996.

Spectral subtraction involves estimating the power or magnitude spectrum of the background noise and subtracting that from the power or magnitude spectrum of the contaminated signal. The background noise is usually estimated during noise only sections of the signal. This approach is fairly effective at removing background noise but the remaining speech tends to have annoying artifacts, which are often referred to as "musical noise." Musical noise consists of brief tones occurring at random frequencies and is the result of isolated noise spectral components that are not completely removed after subtraction. One method of reducing musical noise is to subtract some multiple of the noise spectral magnitude (this is referred to as spectral oversubtraction). Spectral oversubtraction reduces the residual noise components but also removes excessive amounts of the speech spectral components resulting in speech that sounds hollow or muted.

A related method for background noise reduction is to estimate the optimal gain to be applied to each spectral component based on a Wiener or Kalman filter approach. The Wiener and Kalman filters attempt to minimize the expected error in the time signal. The Kalman filter requires knowledge of the type of noise to be removed and, therefore, it is not very appropriate for use where the noise characteristics are unknown and may vary.

The Wiener filter is calculated from an estimate of the speech spectrum as well as the noise spectrum. A common method of estimating the speech spectrum is via spectral subtraction. However, this causes the Wiener filter to produce some of the same artifacts evidenced in spectral subtraction-based noise reduction.

The musical or flutter noise problem was addressed by McAulay and Malpass (1980) by smoothing the gain of the filter over time. See, "Speech Enhancement Using a Soft-Decision Noise Suppression Filter", *IEEE Transactions on Acoustics, Speech, and Signal Processing* 28(2): 137–145.

However, if the gain is smoothed enough to eliminate most of the musical noise, the voice signal is also adversely affected.

Other methods of calculating an "optimal gain" include minimizing expected error in the spectral components. For example, Ephraim and Malah (1985) achieve good results which are free from musical noise artifacts by minimizing the mean-square error in the short-time spectral components. See, "Speech Enhancement Using a Minimum Mean-Square Error Log-Spectral Amplitude Estimator", *IEEE Transactions on Acoustics, Speech, and Signal Processing* ASSP-33 (2): 443–445. However, their approach is much more computationally intensive than the Wiener filter or spectral subtraction methods. Derivative methods have also been developed which use look-up tables or approximation functions to perform similar noise reduction but with reduced complexity. These methods are disclosed in U.S. Pat. Nos. 5,012,519 and 5,768,473.

Also known is an auditory masking-based technique for reducing background signal noise, described by Virag (1995) and Tsoukalas, Mourjopoulos and Kokkinakis (1997). See, "Speech Enhancement Based On Masking Properties Of The Auditory System," *Proceedings of the International Conference on Acoustics, Speech and Signal Processing*, Vol. 1, pp. 796–799; and "Speech Enhancement Based On Audible Noise Suppression", *IEEE Transactions on Speech and Audio Processing* 5(6): 497–514. That technique requires excessive computation capacity and they do not produce the desired amount of noise reduction.

Other methods for noise reduction include estimating the spectral magnitude of speech components probabilistically as used in U.S. Pat. Nos. 5,668,927 and 5,577,161. These methods also require computations that are not performed very efficiently on low-cost digital signal processors.

Another aspect of the background noise reduction problem is determining when the signal contains only background noise and when speech is present. Speech detectors, often called voice activity detectors (VADs), are needed to aid in the estimation of the noise characteristics. VADs typically use many different measures to determine the likelihood of the presence of speech. Some of these measures include: signal amplitude, short-term signal energy, zero crossing count, signal to noise ratio (SNR), or SNR in spectral subbands. These measures may be smoothed and weighted in the speech detection process. The VAD decision may also be smoothed and modified to, for example, hang on for a short time after the cessation of speech.

U.S. Pat. No. 4,672,669 discloses the use of signal energy that is compared to various thresholds to determine the presence of voice. In U.S. Pat. No. 5,459,814 a voice detector is disclosed with multiple thresholds and multiple measures are used to provide a more accurate VAD decision. However, since speech levels and characteristics and background noise levels and characteristics change, a system with some intelligent control over the levels and VAD decision process is needed. One approach that tailors the VAD smoothing to known speech characteristics is disclosed in U.S. Pat. No. 4,357,491. However, this system is based on processing a signal's time samples; therefore, it does not make use of the unique frequency characteristics which distinguish speech from noise.

In summary, there are methods for reducing noise in speech which are efficient and simple but which produce excessive artifacts. There are also methods which do not produce the musical artifacts but which are computationally intensive. What is needed is an efficient, low-delay method detecting when speech or voice is present in a signal.

SUMMARY OF THE INVENTION

The present invention is directed to a speech or voice activity detector (VAD) for detecting whether speech signals are present in individual time frames of an input signal. The VAD comprises a speech detector that receives as input the input signal, examines the input signal in order to generate a plurality of statistics that represent characteristics indicative of the presence or absence of speech in a time frame of the input signal, and generates an output based on the plurality of statistics representing a likelihood of speech presence in a current time frame. The VAD comprises a state machine coupled to the speech detector that has a plurality of states. The state machine receives as input the output of the speech detector and transitions between the plurality of states based on a state at a previous time frame and the output of the speech detector for the current time frame. The state machine generates as output a speech activity status signal based on the state of the state machine, which provides a measure of the likelihood of speech being present during the current time frame. The VAD is useful in a noise reduction system to remove or reduce noise from a signal containing speech (or a related information carrying signal) and noise.

The above and other objects and advantages of the present invention will become more readily apparent when reference is made to the following description taken in conjunction with the accompanying drawings.

DETAILED DESCRIPTION OF THE INVENTION

Figure 1:
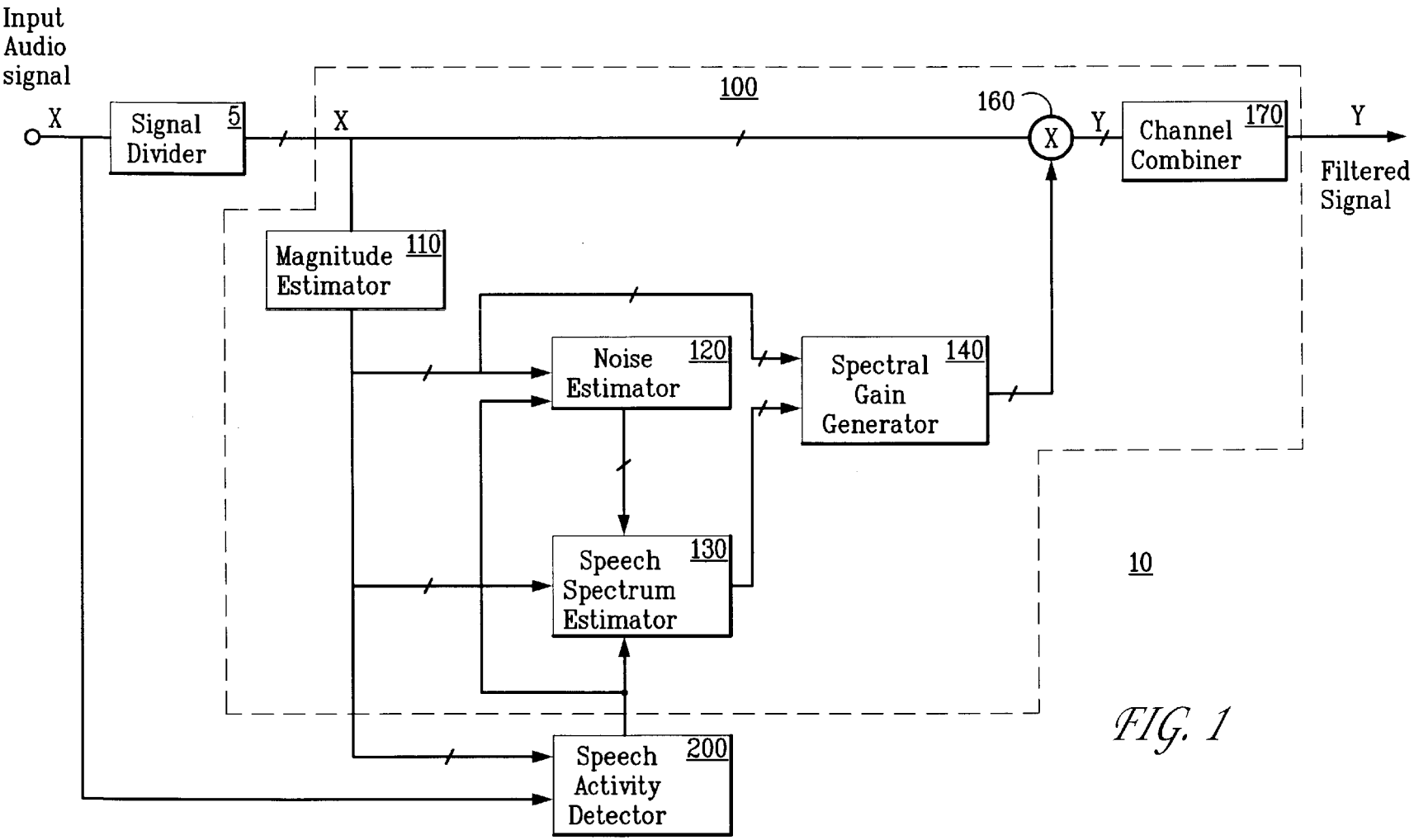
FIG. 1 is a block diagram showing the computation modules of a noise reduction system featuring a speech activity detector according to the present invention.

Referring first to FIG. 1, a noise reduction system featuring a speech or voice activity detector (VAD) according to the present invention is generally shown at reference numeral 10. There are two primary parts to the noise reduction system 10, an adaptive filter 100 and a voice or speech activity detector VAD 200. The adaptive filter 100 attenuates noise in the input signal. The VAD 200 determines when speech is present in a time frame of the input signal.

The adaptive filter 100 comprises a spectral magnitude estimator 110, a spectral noise estimator 120, a speech spectrum estimator 130, a spectral gain generator 140, a multiplier 160 and a channel combiner 170. The signal divider generates a spectral signal X, representing frequency spectrum information for individual time frames of the input signal, and divides this spectral signal for use in two paths. For simplicity, the term "spectral" is dropped in referring to the magnitude estimator 110 and spectral noise estimator 120 herein.

The VAD 200 receives as input an output signal from the magnitude estimator 110 and the input signal x and generates as output a speech activity status signal that is coupled to several modules in the adaptive filter 100 as will be explained in more detail hereinafter. The speech activity status signal output by the VAD 200 is used by the adaptive filter 100 to control updates of the noise spectrum and to set various time constants in the adaptive filter 100 that will be described below.

In the following discussion, the characteristics of the signals (variables) described are either scalar or vector. The index m is used to represent a time frame. All of the variables indexed by m only, e.g., [m], are scalar valued. All of the variables indexed by two variables, such as by [k; m] or [l,m], are vectors. When "l" (lower case "L") is used, it indicates indexing of a smoothed, sampled vector (in a preferred implementation the length of all of these is 16, though other lengths are suitable). The index k is used to represent the frequency band index (also called bins) values derived from or applied to each of the discrete Fourier transform (DFT) bins. Furthermore, in the figures, any line with a slash through it indicates that it is a vector.

The input signal, x, to the system 10 is a digitally sampled audio signal that is sampled at least 8000 samples per second. The input signal is processed in time frames and data about the input signal is generated during each time frame. It is assumed that the input signal x contains speech (or a related information bearing signal) and additive noise so that it is of the form $$x[n]=s[n]+n[n] \tag{1}$$

where s[n] and n[n] are speech (voice) and noise signals respectively and x[n] is the observed signal and system input. The signals s[n] and n[n] are assumed to be uncorrelated so their power spectral densities (PSDs) add as $$\Gamma_x(\omega)=\Gamma_s(\omega)+\Gamma_n(\omega) \tag{2}$$

where $\Gamma_s(\omega)$ and $\Gamma_n(\omega)$ are the PSDs of the speech and noise respectively. See, *Adaptive Filter Theory*, $2^{nd}$ ed., Prentice Hall, Englewood Cliffs, N.J. (1991) and *Discrete-Time Processing of Speech Signals*, Macmillan (1993).

A short term or single frame approximation of an ideal Wiener filter is given by $$H^{\dagger}(k;m)=\frac{\Gamma_s(k;m)}{\Gamma_s(k;m)+\Gamma_n(k;m)} \tag{3}$$

where k is the frequency band index and m is the frame index.

Since $\Gamma_s(k;m)$ and $\Gamma_n(k;m)$ are not known, they are estimated using the windowed discrete Fourier transform (DFT). The windowed DFT is given by $$X(k;m)=\sum_{n=0}^{N_w-1} w[n]x[n-mN_f]e^{-i2\frac{\pi kn}{N_w}} \tag{4}$$

where $N_w$ is the window length, $N_f$ is the frame length, and w[n] is a tapered window such as the Hanning window given in Equation 5:

$$w[n]=\frac{1}{2}-\frac{1}{2}\cos\left(\frac{2\pi(n+1)}{N_w+1}\right) \tag{5}$$

The window length, $N_w$, is usually chosen so that $N_w \approx 2N_f$ and $0.008 \leqq N_w/F_s \leqq 0.032$ where $F_s$ is the sample frequency of x[n]. However, other window lengths are suitable and this is not intended to limit the application of the present invention.

The adaptive filter 100 will now be described in greater detail. The magnitude estimator 110 generates an estimated spectral magnitude signal based on the spectral signal for individual time frames of the input signal. One technique known to be useful in generating the estimated spectral magnitude signal is based on the square root of the noise PSD. It is also possible to estimate the actual PSD and the system 100 described herein can work either way. The estimated spectral magnitude signal is a vector quantity and is coupled as input to the noise estimator 120, the speech spectrum estimator 130 and the spectral gain generator 140. The DFT derived PSD estimates are denoted with hats (^).

Figure 2:
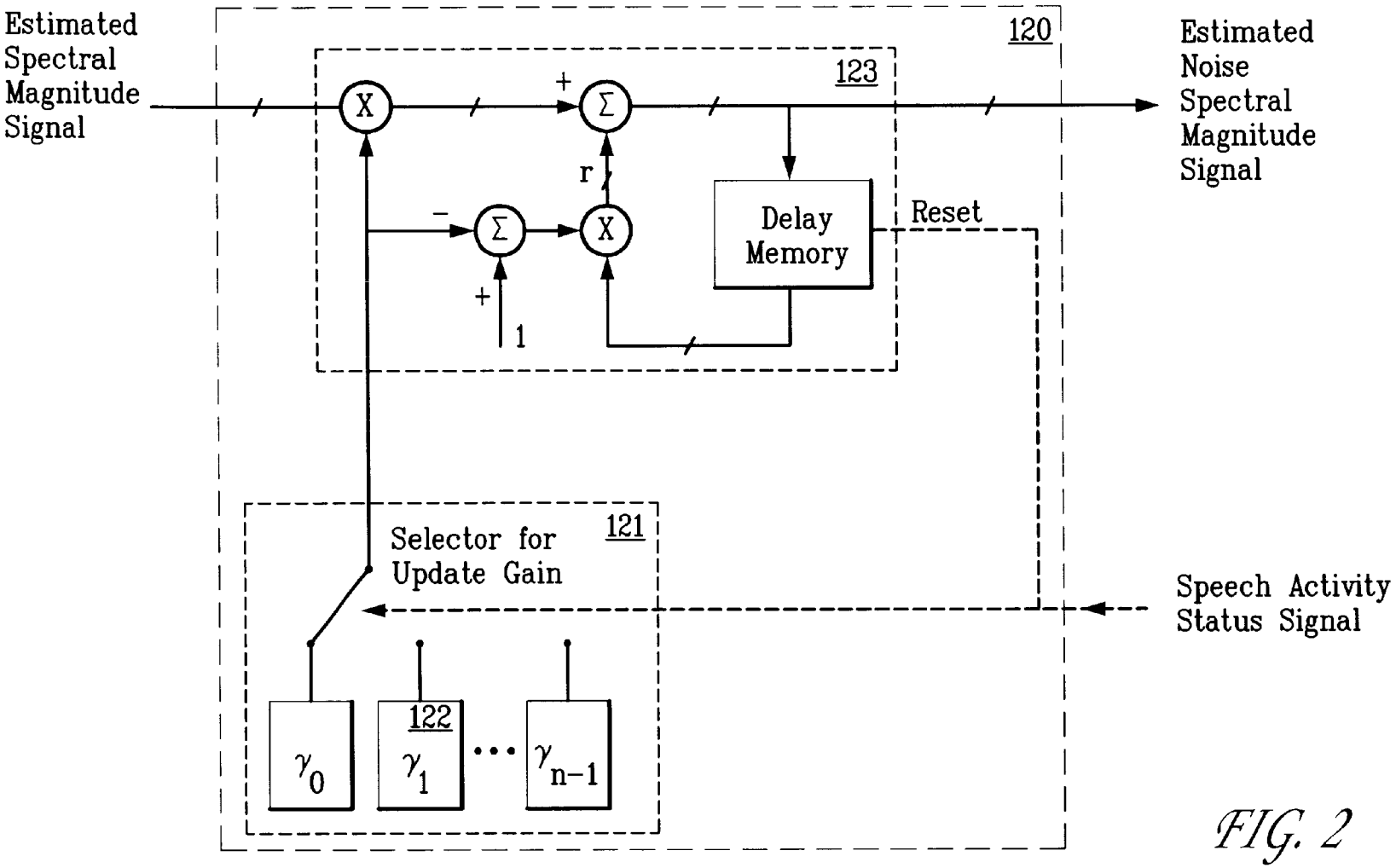
FIG. 2 is a block diagram of a noise estimator module.

The noise estimator 120 is shown in greater detail in FIG. 2. The noise estimator 120 comprises a computation module 123 and a selector module 121. The selector module 121 receives as input the speech activity status signal from the VAD 200 and generates a noise update factor γ(m) that is usually fixed but during a reset of the VAD 200, it is changed to 0.0, then for about 100 msec following the reset, a lower-than-normal fixed value is set to allow for faster noise spectrum updates. The output of the noise estimator 120 is an estimated noise spectral magnitude signal $\Gamma_n^{1/2}(k;m)$ found according to the equations:

$$\Gamma_n^{\frac{1}{2}}(k;m) = \begin{cases} \max\left[\gamma(m)\Gamma_n^{\frac{1}{2}}(k;m-1) + (1-\gamma(m))\Gamma_n^{\frac{1}{2}}(k;m), 0\right] & \text{non-speech frame} \\ \Gamma_n^{\frac{1}{2}}(k;m-1) & \text{speech frame} \end{cases} \tag{6}$$

Figure 3:
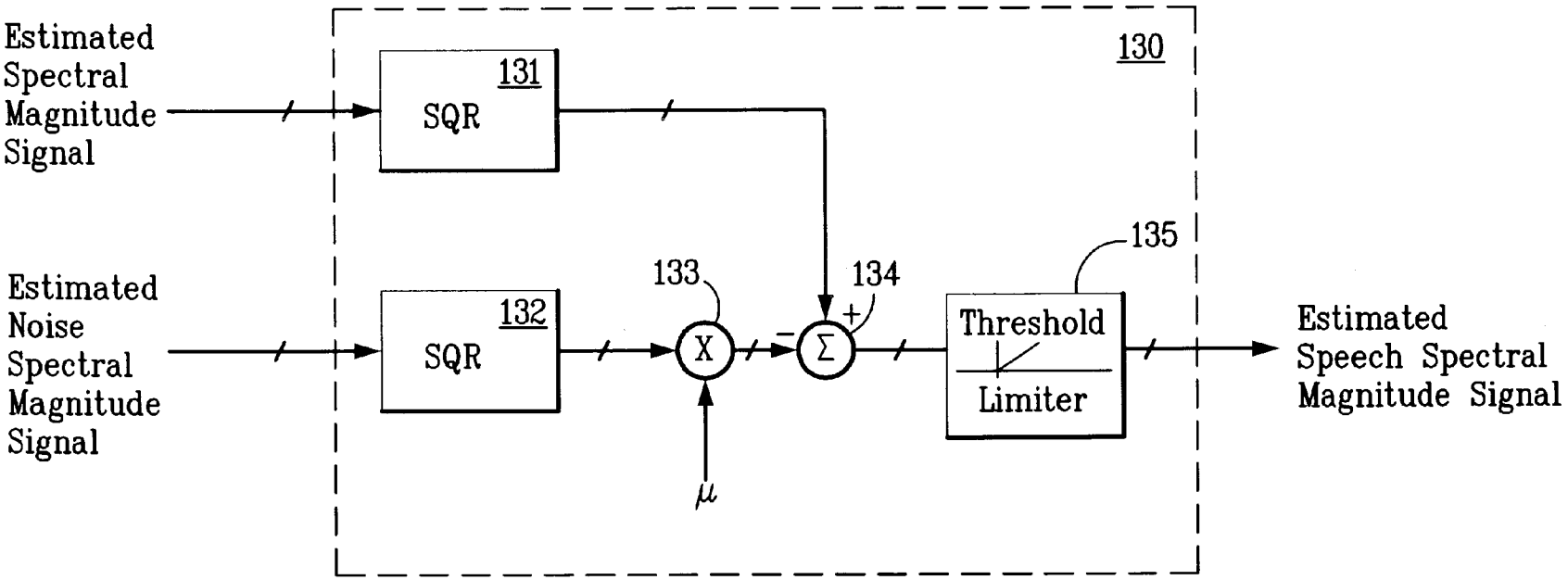
FIG. 3 is a block diagram of the speech spectrum estimator module.

The speech spectrum estimator 130 is shown in greater detail in FIG. 3. The speech spectrum estimator 130 comprises first and second squaring (SQR) computation modules 131 and 132. SQR module 131 receives the estimated spectral magnitude signal from the magnitude estimator 110 and SQR module 132 receives the noise estimate signal from the noise estimator 120. The multiplier 133 multiplies the (square of the) estimated noise spectral magnitude signal by the noise multiplier. The adder 134 adds the output of the SQR 131 and the output of the multiplier 133. The output of the adder is coupled to a threshold limiter 135. In essence, the estimated speech spectral magnitude signal is generated by subtracting from the estimated spectral magnitude signal a product of the noise multiplier and the estimated noise spectral magnitude signal. The output of the speech spectrum estimator 130 is the estimated speech spectral magnitude signal $\hat{\Gamma}_s(k;m)$:

$$\hat{\Gamma}_s(k;m)=\max[\hat{\Gamma}_x(k;m)-\mu\hat{\Gamma}_n(k;m),0] \tag{7}$$

where $\hat{\Gamma}_x(k;m)=|X(k;m)|^2$, $\mu$ is the noise multiplier.

Equation (7) estimates the speech power spectrum by spectral subtraction as illustrated in FIG. 3. A common problem with spectral subtraction is that short-term spectral noise components may be greater than the estimated noise spectrum and are, therefore, not completely removed from the estimated speech spectrum. One way to reduce the residual noise components in the speech spectrum estimate is to subtract some multiple of the estimated noise spectrum—this is called oversubtraction or noise multiplication. Oversubtraction removes some of the speech, but nevertheless eliminates more of the noise resulting in fewer "musical noise" artifacts.

The noise multiplier, $\mu$, in this implementation, determines the amount of oversubtraction. Typical values for the noise multiplier are between 1.2 and 2.5.

Figure 4:
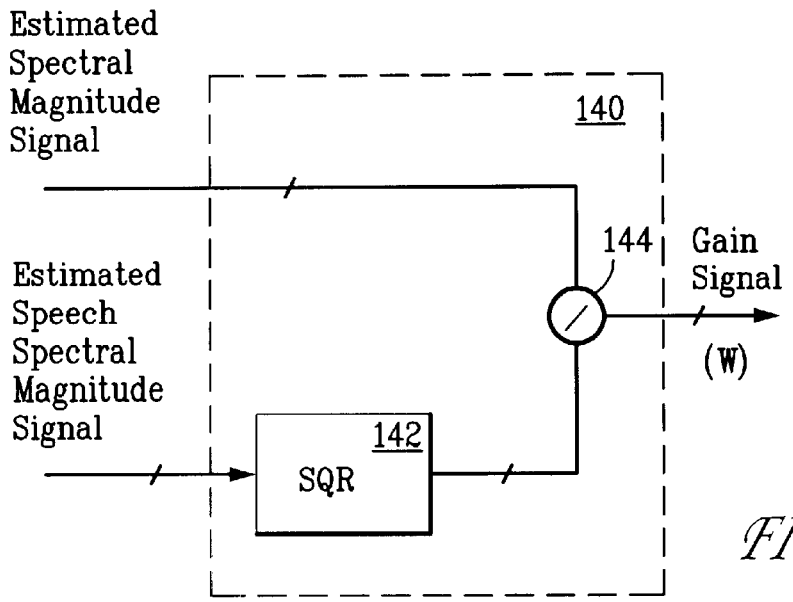
FIG. 4 is a block diagram of the spectral gain generator module.

The spectral gain generator 140 is shown in greater detail in FIG. 4. The spectral gain generator 140 comprises an SQR module 142 and a divider module 144. Given the estimated PSDs for noise and speech spectrum above, an estimate of the Wiener gain, $\hat{H}(k;m)$, of the optimal Wiener filter is obtained as $$\hat{H}(k;m) = \frac{\hat{\Gamma}_s(k;m)}{\hat{\Gamma}_x(k;m)} \tag{8}$$

Note that, for the denominator of $\hat{H}(k;m)$, $\hat{\Gamma}_x(k;m)$ is used in place of $\hat{\Gamma}_s(k;m)+\hat{\Gamma}_n(k;m)$, as indicated in FIG. 4. Thus, the spectral gain signal output by the spectral gain generator 140 is computed according to Equations 3, 4 and 5 above. In sum, the spectral gain generator receives as input the estimated spectral magnitude signal and the estimated speech spectral magnitude signal and generates as output a spectral gain signal that yields an estimate of speech spectrum in a time frame of the input signal when the spectral gain signal is applied to the spectral signal (output by the signal divider 5).

Referring again to FIG. 1, in the adaptive filter 100, the spectral gain signal is coupled to the multiplier 160. The multiplier 160 multiplies the spectral signal, X, by the spectral gain signal to generate a speech spectrum signal (with added noise removed). The speech spectrum signal, Y, is then coupled to the channel combiner 170. The channel combiner 170 performs an inverse operation of the signal divider 5 to convert the frequency-based speech spectrum signal Y to a time domain speech signal y. For example, if the signal divider 5 employs a DFT operation, then the channel combiner 170 performs an inverse DFT operation with overlap/add synthesis since the DFT operates on overlapping blocks, that is, the window length is longer than the frame length of frame skip.

Figure 5:
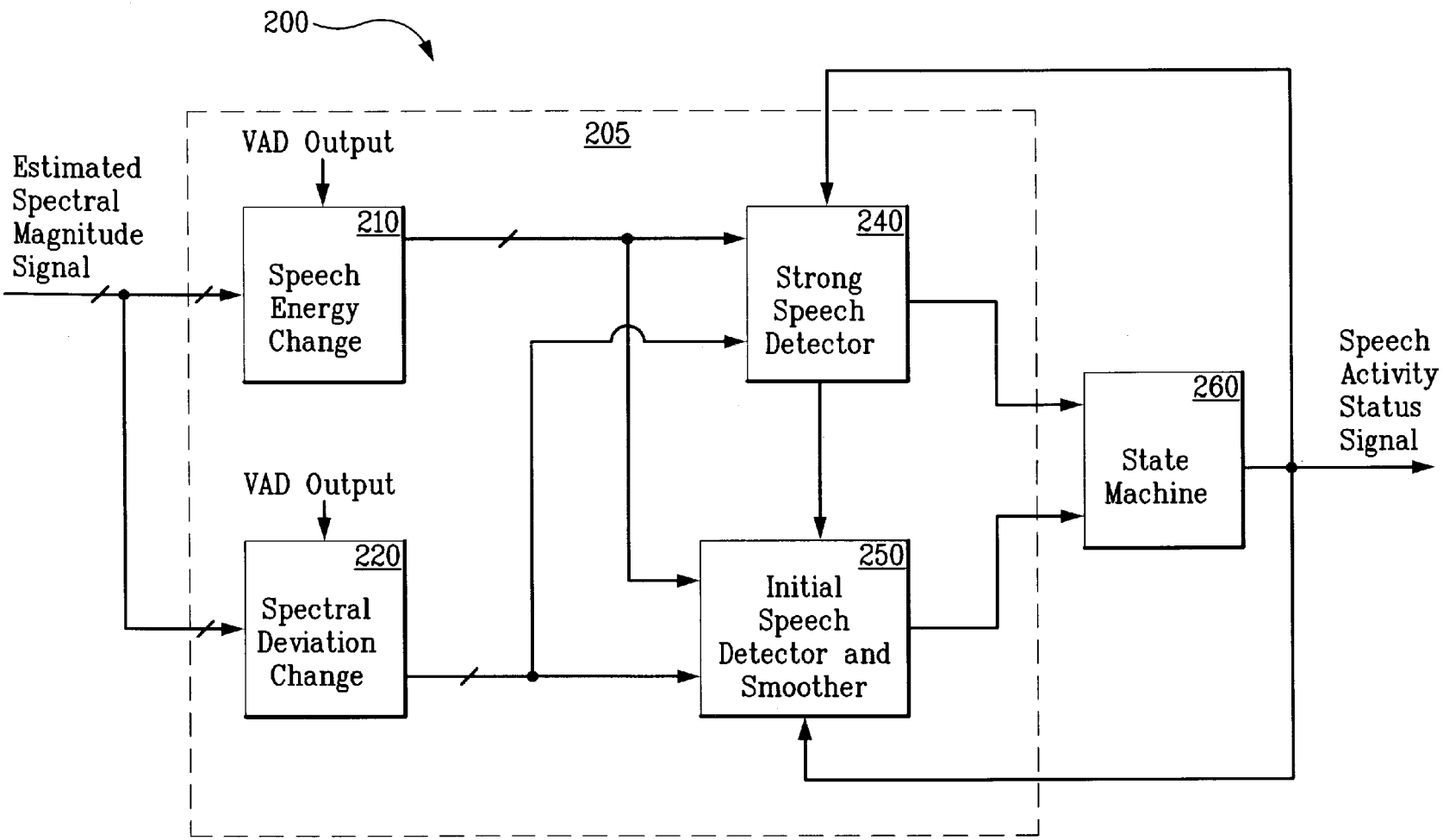
FIG. 5 is a block diagram of the speech activity detector.

The VAD 200 is shown in FIG. 5, and comprises a speech detector 205 and a state machine 260. Generally, the speech detector 205 generates a first output signal when it is determined based on a plurality of the statistics that speech is strongly present in a time frame and generates a second output sign when it is initially estimated that speech is present in a time frame. The state machine 260 receives as input the first and second output signals from the speech detector 205.

The speech detector 205 provides an initial estimate of the presence of speech in the current frame. This initial estimate is then smoothed against previous frames and presented to the state machine 260. The state machine 260 provides context and memory for interpreting the speech detector output, greatly increasing the overall accuracy of the VAD 200. The state machine 260 outputs a speech activity status signal based on the state of the state machine 260, that provides a measure of the likelihood of speech being present during a current time frame. In addition, the states of the state machine 260 indicate whether the tail end of speech activity is detected, and possibly if a reset is needed. The five possible states of the state machine 260 are:

R Reset

A Active (speech activity detected)

C Certain speech activity (strong speech activity detected)

T Transition (transition between speech and no speech)

I Inactive (no speech present)

These states will be described in further detail hereinafter.

Speech activity is initially determined by examining statistics generated by a speech energy change module 210 and a spectral deviation module 220. These modules generate statistics that relate the current frame to noise only frames. The statistics or parameters generated by modules 210, 220 are coupled to the certain speech detection module 240 and the speech detection and smoothing module 250. Each of these modules receives as input the speech activity status signal from the VAD 200 for the prior time frame.

Speech Energy Change

In the speech energy change module 210, the energy in the speech frequency band, $E_{sb}[m]$, is calculated by summing the energy in all the DFT bins corresponding to frequencies below about 4000 Hz and above about 300 Hz (to eliminate DC bias problems). During non-speech frames $E_{sb}[m]$ is used to update the estimated noise energy in the speech bands, $E_n[m]$. Whenever $E_{sb}[m]$ exceeds $E_n[m]$by a predetermined amount, typically 3 dB, it is an indication that speech is present. This relationship is expressed by the ratio $$\delta E_{sb}[m] = \frac{E_{sb}[m]}{E_n[m-1]} \tag{11}$$

Note that $E_n[m-1]$ is used because $E_n[m]$ is determined after the VAD decision is made.

The ratio $\delta E_{sb}[m]$ is also used as an indicator of strong speech. Strong speech is signaled when $E_{sb}[m]$ exceeds $E_n[m-1]$ by a greater amount, typically about 7 dB, i.e. when $\delta E_{sb}[m]>5$.

Spectral Deviation

In the spectral deviation module 220, the spectral shape or spectral envelope is determined by low-pass filtering (smoothing) the magnitude spectrum. The spectral shape may also be determined by other methods such as using the first few LPC or cepstral coefficients. For speech detection this is then subsampled so that only 16 samples are used to represent the spectral envelope for frequencies between 0 and 4000 Hz. By only using samples corresponding to frequencies below some fixed value (such as 4000 Hz) it is possible to accurately detect spectral changes due to speech regardless of the sample rate.

The decimated spectral envelope of the "speech" frequencies, $X_{env}[l;m]$, is used to estimate the corresponding smooth noise spectrum, $N_{env}[l;m]$, during noise only frames. $N_{env}$, $[l;m]$ is found using an update equation that permits it to decrease faster than it increases (see Equation 12 below). This helps $N_{env}[l;m]$ to quickly recover if any speech frames are incorrectly used in its update.

$$N_{env}[l;m] = \begin{cases} \min[\max(X_{env}[l;m], N_{env}[l;m-1]*\varphi_l), N_{env}[l;m-1]*\varphi_u] & \text{non-speech frame} \\ N_{env}[l;m-1] & \text{speech frame} \end{cases}$$

where typical values for the adaptation parameters are $\phi_l$=0.985 and $\phi_u$=1.003. $X_{env}[l;m]$ and $N_{env}[l;m-1]$ are used in defining the spectral difference $$\Delta S[m] = \sum_{l=0}^{15} (X_{env}[l;m] - N_{env}[l;m-1]). \tag{13}$$

A maximum likelihood detector is then used to detect the presence of speech based on this spectral difference $\Delta S[m]$.

The maximum likelihood detector assumes that $\Delta S[m]$ represents the realization of either of two Gaussian random processes, one associated with noise and the other associated with speech. A log likelihood ratio test is used to implement the detector:

$$L = \frac{1}{2}\log\frac{\sigma^2_{[\Delta S|n]}[m]}{\sigma^2_{[\Delta S|s]}[m]} - \frac{(\Delta S[m] - \mu_{[\Delta S_i s]}[m])^2}{2\sigma^2_{[\Delta S|s]}[m]} + \frac{(\Delta S[m] - \mu_{[\Delta S|n]}[m])^2}{2\sigma^2_{[\Delta S|n]}[m]} > 0 \tag{14}$$

where $\mu_{\{\Delta S|s\}}[m]$ and $\mu_{\{\Delta S|n\}}[m]$ are the averages (means) of $\Delta S[m]$ during speech and non-speech frames, respectively, and $\sigma_{\{\Delta S|s\}}{}^2[m]$ and $\sigma_{\{\Delta S|n\}}{}^2[m]$ are the respective variances. Both the means and variances are updated using a leaky update of the type shown in Equation (15) below, so that recent samples are weighted more heavily.

Spectral difference is also used as an indication of strong speech. In this case, average or large values of $\Delta S[m]$ over a period of several frames are used as indicators of strong speech. When a short-term average, $\mu_{\Delta S}[m]$, of $\Delta S[m]$ exceeds $\mu_{\{\Delta S|s\}}[m]$ by some fraction, then the state machine 260 assumes that speech has been certainly or strongly observed.

The short term average is found using a first order IIR filter $$\mu_{\Delta S}[m]=\xi\mu_{\Delta S}[m-1]+(1-\xi)\Delta S[m] \tag{15}$$

where $\xi$ is around 0.7 for 8 millisecond frames.

Smoothing Non-Speech→Speech

If it has been over five frames since the VAD 200 entered state (R) then the non-speech decision will be overridden to a speech decision if any of the following conditions are true.

1. $E_{sb}[m]>8E_{sb,min}[m]$
2. $E_{sb}[m]>0.8E_{sb}[m-1]$ and $E_{sb}[m]>0.8E_{sb}[m-2]$ and the VAD has be (C) for at least 2 frames.
3. $\mu_{\Delta S}[m]>1.3\mu_{\{\Delta S|n\}}[m]$ and the VAD has been in state (A) or (C) for at least 6 frames.

Smoothing Speech-Non→Speech

If only one of the terms in Equation (18) is true then the speech decision will be overridden to a non-speech decision if any of the following conditions are true.

1. The non-smoothed speech decision on the previous frame was non-speech and the conditions are not met to enter state (C).
2. $E_{sb}[m]-E_{sb}[m-1]<0.5E_n$ and the VAD has been in state (I) for at least 9 frames.
3. $\delta E_{sb}[m]<0.8$ and $\angle[m]<0$.
4. $\delta E_{sb}[m]<1.0$ and only one of the speech decision inequalities is true.

In sum, the speech detector generates a speech energy change statistic representing a change in energy within speech frequency bands between a first group of one or more time frames and a second group of one or more time frames, and a spectral deviation change statistic representing a change in the spectral shape of speech frequency bands of the input signal between a first group of one or more time frames and a second group of one or more time frames.

The initial speech detector 250 receives as inputs the spectral deviation change statistic and the speech energy change statistic and provides as output a measure of the presence of speech in the current frame. A speech detection smoother included within the initial speech detector 250 receives as input the output of the initial speech detector and smoothes the output of the initial speech detector and characteristics of the input signal to the initial speech detector for a number of prior time frames and generates an output signal indicating the presence of speech based thereon.

Conditions for Strong Speech Activity (State (C))

The initial speech activity decision is made with thresholds tuned make the VAD 200 sensitive enough to detect quiet speech in the presence of noise. This is important especially during speech onset. However, the sensitivity of the speech activity detector makes it subject to false alarms; therefore a second, less sensitive check is also used. The strong speech detector 240, as its name implies, detects a certainty about the presence of speech. The onset of speech is often quiet followed, during the course of the word, by a louder voiced sound. The strong speech conditions are tuned to detect the voiced portion of the speech.

The strong speech detector 240 receives as input the speech energy change and spectral deviation statistics as well as the prior VAD output. The conditions in the strong speech detector 240 for strong speech are:

$$\delta E_{sb}[m]>5.0 \text{ or } \mu_{\Delta S}[m]>\mu_{\{\Delta S|S\}}[m] \tag{18}$$

To summarize, the strong speech detector 240 generates an output signal indicating that speech is strongly present in a time frame when the speech energy change statistic exceeds a threshold value or when the short-term average of the spectral 10 deviation change statistic over several time frames exceeds an average for speech time frames.

The VAD State Machine

Figure 6:
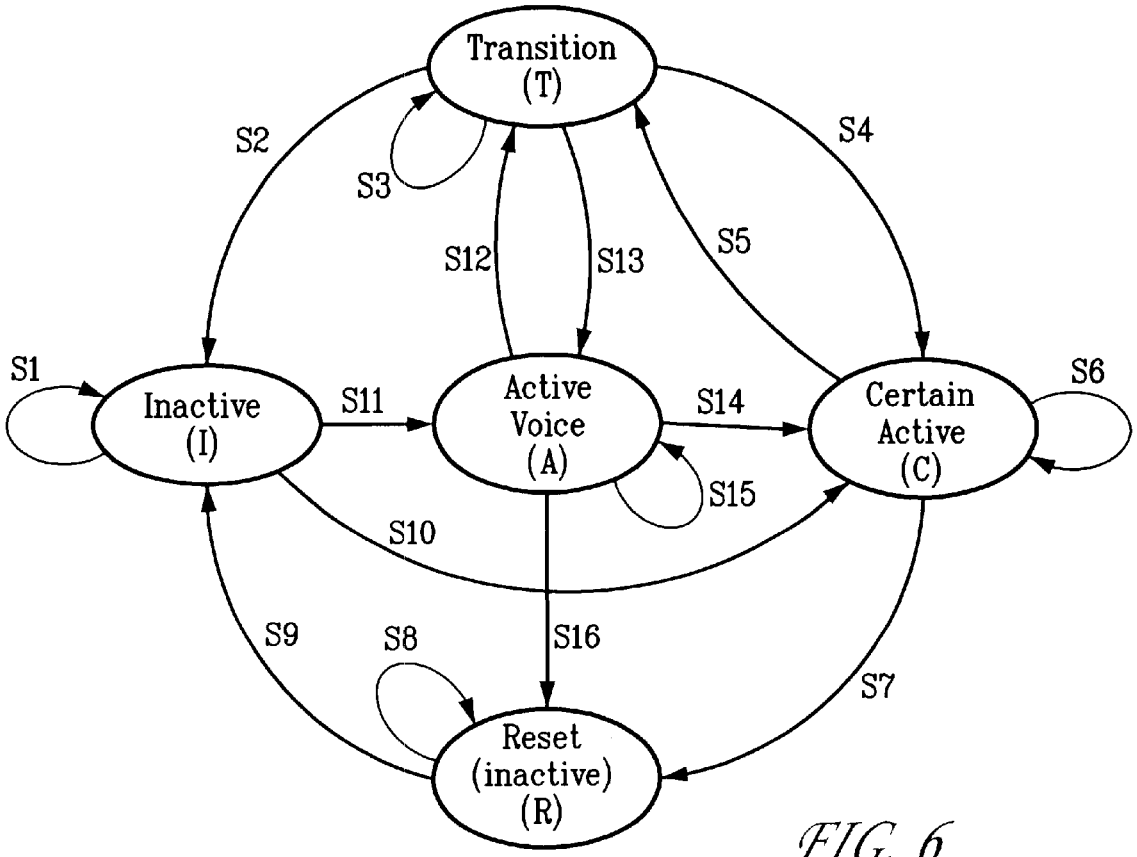
FIG. 6 is a state diagram of the state machine in the voice activity detector.

The state machine 260 is represented by the state diagram shown in FIG. 6. In the preferred embodiment, the VAD 200 has fives states—with additional information stored in a counter that records how long the VAD 200 remains in any particular state. A description of each of the VAD states and the corresponding filter behavior is given in Table 1.

Table 1. The VAD states.

The state transitions labeled in FIG. 6 are each described below.

[S1] The VAD 200 remains in the state (I) until speech or certain speech is detected. When the system is first started it can only leave state (I) when certain speech is detected. This is to give the VAD parameters an opportunity to adjust without unnecessary false alarms.

[S2] This occurs after the VAD is in state (T) for about 40 milliseconds. [As an example, for a frame rate of 125 frames per second the frames occur every 8 milliseconds. Thus 40 milliseconds corresponds to 5 frames at this frame rate.]

[S3] The VAD remains in (T) for about 40 milliseconds unless speech activity is detected.

[S4] Same conditions as [S10] below.

[S5] Occurs if no speech activity is detected.

[S6] The VAD remains in state (C) as long as the conditions described for

[S10] or until the conditions for [S7] are met.

[S7] Occurs if the VAD is in state (C) for 2.5 seconds.

[S8] The VAD remains in reset for about 40 milliseconds. After about 40 milliseconds the VAD enters state (I) but the noise statistics continue to be updated more rapidly for another 120 milliseconds.

[S9] After about 40 milliseconds in state (R) the VAD enters state (I) but the noise statistics continue to be updated more rapidly for another 120 milliseconds.

[S10] The VAD enters state (C) if either expression in Equation (18) evaluates true.

[S11] The VAD enters state (A) if the speech activity decision smoother described above indicates speech and the conditions described for [S10] are not satisfied.

[S12] Occurs if no speech activity is detected.

[S13] Same conditions as [S11].

[S14] Same conditions as [S10].

[S15] As long as the conditions described for [S11] are met and the conditions described for [S16] are not met the VAD will remain in state (A).

[S16] Occurs if the VAD is in state (A) for 0.3 seconds. (If not in state (C) after 0.3 seconds then assume it is a false alarm.)

There are several aspects of the system and method according to the present invention that contribute to its

TABLE 1

The VAD states.

| State | Description | VAD Behavior | Filter Behavior |
|---|---|---|---|
| (I) | No speech Activity. | The noise statistics are updated. | The spectral gain is calculated using 2.5 x's oversubtraction and maximum interframe smoothing. |
| (A) | Speech activity detected. | The VAD can only remain in this state for 0.3 seconds before triggering a reset. | The spectral gain is calculated using 1.2 x's oversubtraction and the interframe smoothing is decreased. |
| (C) | Strong or certain speech activity detected. | The VAD can remain in this state for 2.5 seconds before triggering a reset. | Same as (A). |
| (T) | Transition from speech activity to inactivity. (This consists of several states, which are represented together here for simplicity.) | The noise statistics are not updated for 2–3 frames. | The smoothing of the spectral gain is the same as for (A) & (C) and the oversubtraction factor changes gradually to equal that of (I). |
| (R) | VAD Reset. | Noise statistics are reset upon entry into (R), behaves as if in late (I) except the noise statistics are updated quickly. | There is no interframe smoothing on the spectral gain. |

successful operation and uniqueness. Most notable is that the VAD includes a state machine that provides fast recovery from errors due to changing noise conditions. This is accomplished by having multiple levels of speech activity certainty and resetting the VAD if a normal pattern of increasing in certainty is not observed. Thus, the speech activity detector associated with the system is effective in a variety of noise conditions and it is able to recover quickly from errors due to abrupt changes in the noise background.

In addition, the system is designed to work with a range of analysis window lengths and sample rates. Moreover, the system is adaptable in the amount of noise it removes, i.e. it can remove enough noise to make the noise only periods silent or it can leave a comfortable level of noise in the signal which is attenuated but otherwise unchanged. The latter is the preferred mode of operation. The system is very efficient and can be implemented in real-time with only a few MIPS at lower sample rates. The system is robust to operation in a variety of noise types. It works well with noise that is white, colored, and even noise with a periodic component. For systems with little or no noise there is little or no change to the signal, thus minimizing possible distortion.

The system and methods according to the present invention can be implemented in any computing platform, including digital signal processors, application specific integrated circuits (ΔSICs), microprocessors, etc.

In summary, the present invention is directed to a speech activity detector for detecting whether speech signals are present in individual time frames of an input signal, the speech activity detector comprising: a speech detector that receives as input the input signal and examines the input signal in order to generate a plurality of statistics that represent characteristics indicative of the presence or absence of speech in a time frame of the input signal, and generates an output based on the plurality of statistics representing a likelihood of speech presence in a current time frame; and a state machine coupled to the speech detector and having a plurality of states, the state machine receiving as input the output of the speech detector and transitioning between the plurality of states based on a state at a previous time frame and the output of the speech detector for the current time frame, the state machine generating as output a speech activity status signal based on the state of the state machine which provides a measure of the likelihood of speech being present during the current time frame.

Similarly, the present invention is directed to a method of detecting speech activity in individual time frames of an input signal, comprising steps of: generating a plurality of statistics from the input signal, the statistics representing characteristics indicative of the presence or absence of speech in the time frame of the input signal; defining a plurality of states of a state machine; transitioning between states of the state machine based on a set of rules dependent on the plurality of statistics for a current time frame and the state of the state machine at a previous time frame; and generating a speech activity status signal based on the state of the state machine, wherein the speech activity status signal provides a measure of the likelihood of speech being present during the current time frame.

In addition, the present invention is directed to an adaptive filter that receives an input signal comprising a digitally sampled audio signal containing speech and added noise, the adaptive filter comprising: a signal divider for generating a spectral signal representing frequency spectrum information for individual time frames of the input signal; a magnitude estimator for generating an estimated spectral magnitude signal based upon the spectral signal for individual time frames of the input signal; a noise estimator receiving as input the estimated spectral magnitude signal and generating as output an estimated noise spectral magnitude signal for a time frame, the estimated noise spectral magnitude signal representing average spectral magnitude values for noise in a time frame; a speech spectrum estimator receiving as input the estimated noise spectral magnitude signal and the estimated spectral magnitude signal for a time frame, the speech spectrum estimator generating an estimated speech spectral magnitude signal representing estimated spectral magnitude values for speech in a time frame by subtracting from the estimated spectral magnitude signal a product of a noise multiplier and the estimated noise spectral magnitude signal.

Similarly, the present invention is directed to a method for filtering an input signal comprising a digitally sampled audio signal containing speech and added noise, the method comprising: generating an estimated spectral magnitude signal representing frequency spectrum information for individual time frames of the input signal; generating an estimated noise spectral magnitude signal representing average spectral magnitude values for noise in a time frame of the input signal based on the estimated spectral magnitude signal; generating an estimated speech spectral magnitude signal in a time frame of the input signal by subtracting from the estimated spectral magnitude signal a product of a noise multiplier and the estimated noise spectral magnitude signal.

The above description is intended by way of example only and is not intended to limit the present invention in any way except as set forth in the following claims.

We claim:

1. A speech activity detector for detecting whether speech signals are present in individual time frames of an input signal, the speech activity detector comprising:

a speech detector that receives as input the input signal and examines the input signal in order to generate a plurality of statistics that represent characteristics indicative of the presence or absence of speech in a time frame of the input signal, and generates an output based on the plurality of statistics representing a likelihood of speech presence in a current time frame, the plurality of statistics further comprising:

a speech energy change statistic representing a change in energy within speech frequency bands between a first group of one or more time frames and a second group of one or more time frames; and a spectral deviation change statistic representing a change in the spectral shape of speech frequency bands of the input signal between a first group of one or more time frames and a second group of one or more time frames; and a state machine coupled to the speech detector and having a plurality of states, the state machine receiving as input the output of the speech detector and transitioning between the plurality of states based on a state at a previous time frame and the output of the speech detector for the current time frame, the state machine generating as output a speech activity status signal based on the state of the state machine which provides a measure of the likelihood of speech being present during the current time frame, the plurality of states comprising:

a reset state representing identification of a change in background noise level; and one or more speech present states, wherein each of the one or more speech present states has an associated likelihood of speech being present during the current time frame.

2. The speech activity detector of claim 1, wherein the speech detector comprises a detector of strong speech that receives as inputs the speech energy change statistic and the spectral deviation change statistic and generates an output signal indicating that speech is strongly present in the current time frame when the speech energy change statistic exceeds a threshold value or when a short-term average of the spectral deviation change statistic over several time frames exceeds an average for time frames determined to contain speech.

3. The speech activity detector of claim 1 or 2, wherein the speech detector comprises an initial speech detector receiving as inputs the spectral deviation change statistic and the speech energy change statistic and providing as output a measure of the presence of speech in the current frame, and a speech detection smoother which receives as input the output of the initial speech detector and smoothes the output of the initial speech detector and characteristics derived from the input signal to the initial speech detector for a number of prior time frames and generates an output signal indicating the presence of speech based thereon.

4. The speech activity detector of claim 1, wherein the state machine comprises a first state representing no speech activity, a second state representing detection of speech activity, a third state representing detection of strong speech activity, and a fourth state representing transition from speech activity or strong speech activity to inactivity.

5. The speech activity detector of claim 1, wherein the speech detector generates a first output signal when it is determined based on the plurality of the statistics that speech is strongly present in a time frame and generates a second output signal when it is initially estimated that speech is present in a time frame.

6. A noise reduction system comprising the speech activity detector of claim 1, the noise reduction system further comprising:

a signal divider for generating a spectral signal representing frequency spectrum information for individual time frames of the input signal;

a magnitude estimator for generating an estimated spectral magnitude signal based upon the spectral signal for individual time frames of the input signal;

a noise estimator receiving as input the estimated spectral magnitude signal and generating as output an estimated noise spectral magnitude signal for a time frame, the estimated noise spectral magnitude signal representing average spectral magnitude values for noise in a time frame;

a speech spectrum estimator receiving as input the estimated noise spectral magnitude signal and the estimated spectral magnitude signal for a time frame, the speech spectrum estimator generating an estimated speech spectral magnitude signal representing estimated spectral magnitude values for speech in a time frame by subtracting from the estimated spectral magnitude signal a product of a noise multiplier and the estimated noise spectral magnitude signal.

7. The speech activity detector of claim 1, wherein the one or more speech present states comprises a plurality of speech present states that comprises a strong speech present state representing strong detection of speech activity.

8. The speech activity detector of claim 7, wherein the state machine transitions to the reset state from the strong speech present state whenever the state machine has remained in the strong speech present state for a designated period of time.

9. The speech activity detector of claim 8, wherein the designated period is about 1 second.

10. The speech activity detector of claim 7, wherein the one or more speech present states consists of the strong speech present state and a lesser speech present state having an associated likelihood of speech present of a lesser value than the strong speech present state.

11. The speech activity detector of claim 10, wherein the state machine transitions to the reset state from the lesser speech present state whenever the state machine has remained in the lesser speech present state for a designated period of time.

12. The speech activity detector of claim 11, wherein the designated period is about 3 seconds.

13. The speech activity detector of claim 7, wherein the likelihood of speech present associated with the strong speech present state is greater than the likelihood of speech present associated with any other speech present state of the one or more speech present states.

14. A method of detecting speech activity in individual time frames of an input signal, comprising steps of:

generating a plurality of statistics from the input signal, the statistics representing characteristics indicative of the presence or absence of speech in the time frame of the input signal, the plurality of statistics further comprising:

a speech energy change statistic representing a change in energy within speech frequency bands between a first group of one or more time frames and a second group of one or more time frames; and a spectral deviation change statistic representing a change in the spectral shape of speech frequency bands of the input signal between a first group of one or more time frames and a second group of one or more time frames; and defining a plurality of states of a state machine, the plurality of states comprising:

a reset state representing identification of a change in background noise level; and one or more speech present states, wherein each of the one or more speech present states has an associated likelihood of speech being present during the current time frame;

transitioning between states of the state machine based on a set of rules dependent on the plurality of statistics for a current time frame and the state of the state machine at a previous time frame; and generating a speech activity status signal based on the state of the state machine, wherein the speech activity status signal provides a measure of the likelihood of speech being present during the current time frame.

15. The method of claim 8, and further comprising the step of generating a signal indicating detection of strong presence of speech in a time frame when the speech energy change statistic exceeds a threshold value or when a short-term average of the spectral deviation change statistic over several time frames exceeds an average for time frames determined to contain speech, wherein the step of transitioning between states of the state machine is responsive to the signal indicating detection of strong speech.

16. The method of claim 8, and further comprising the steps of examining a relationship between speech energy for a current time frame and speech energy for a number of prior time frames, examining a relationship between a spectral deviation change statistic for a current time frame and spectral deviation change statistic during prior non-speech time frames and generating a signal indicating the presence of speech based thereon, wherein the step of transitioning between states of the state machine is responsive to the signal indicating presence of speech.

17. The method of claim 14, wherein the step of defining a plurality of states comprises defining a first state representing no speech activity, a second state representing detection of speech activity, a third state representing strong detection of speech activity, and a fourth state representing transition from speech activity or strong speech activity to inactivity.

18. The method of claim 14, and further comprising the step of generating a first output signal when it is determined based on the plurality of the statistics that speech is strongly present in a time frame and generating a second output signal when it is initially estimated that speech is present in a time frame, wherein the step of transitioning between states of the state machine is responsive to the first and second output signals.

19. A method for removing noise from the input signal comprising the steps of claim 8, and further comprising steps of:

generating an estimated spectral magnitude signal representing frequency spectrum information for individual time frames of the input signal;

generating an estimated noise spectral magnitude signal representing average spectral magnitude values for noise in a time frame of the input signal based on the estimated spectral magnitude signal; and generating an estimated speech spectral magnitude signal in a time frame of the input signal by subtracting from the estimated spectral magnitude signal a product of a noise multiplier and the estimated noise spectral magnitude signal.

* * * * *

UNITED STATES PATENT AND TRADEMARK OFFICE

CERTIFICATE OF CORRECTION

PATENT NO. : 6,453,285 B1
DATED : September 17, 2002
INVENTOR(S) : Anderson et al.

It is certified that error appears in the above-identified patent and that said Letters Patent is hereby corrected as shown below:

Column 14,
Lines 51 and 60, that portion of the claim reading "The method of claim 8" should read -- The method of claim 14 --.

Column 16,
Line 2, that portion of the claim reading "comprising the steps of claim 8" should read -- comprising the steps of claim 14 --.

Signed and Sealed this

Third Day of June, 2003

JAMES E. ROGAN
*Director of the United States Patent and Trademark Office*